US008186022B2

(12) United States Patent
Roser

(10) Patent No.: US 8,186,022 B2
(45) Date of Patent: May 29, 2012

(54) WIRELESS EARBUD SAFETY LOOP

(76) Inventor: Michael G. Roser, Pensacola, FL (US)

( * ) Notice: Subject to any disclaimer, the term of this patent is extended or adjusted under 35 U.S.C. 154(b) by 230 days.

(21) Appl. No.: 12/476,372

(22) Filed: Jun. 2, 2009

(65) Prior Publication Data

US 2010/0000054 A1 Jan. 7, 2010

Related U.S. Application Data

(60) Provisional application No. 61/077,203, filed on Jul. 1, 2008.

(51) Int. Cl.
*A45F 5/00* (2006.01)

(52) U.S. Cl. ..... 24/3.12; 24/3.3; 24/3.11; 24/3.13; 24/11 R; 24/115 K; 24/346

(58) Field of Classification Search ..... 24/3.3, 24/3.11, 3.12, 3.13, 115 K, 11 R, 346; D2/624
See application file for complete search history.

(56) References Cited

U.S. PATENT DOCUMENTS

| | | | | | |
|---|---|---|---|---|---|
| D185,852 | S | * | 8/1959 | McFadyen | D16/339 |
| 3,879,804 | A | * | 4/1975 | Lawrence | 24/3.4 |
| D293,043 | S | * | 12/1987 | Zamboni | D2/624 |
| 4,991,236 | A | * | 2/1991 | Pritchett | 2/195.8 |
| 5,465,466 | A | * | 11/1995 | Napier | 24/3.3 |
| 5,615,454 | A | * | 4/1997 | Contarino | 24/3.13 |
| 5,956,812 | A | * | 9/1999 | Moennig | 24/3.3 |
| 6,179,621 | B1 | * | 1/2001 | Vaccari | 434/246 |
| 6,247,207 | B1 | * | 6/2001 | Nitsche | 24/66.4 |
| 6,285,757 | B1 | | 9/2001 | Carroll et al. | |
| 6,810,987 | B1 | | 11/2004 | DeKalb | |
| 6,826,782 | B2 | | 12/2004 | Jordan | |
| 7,340,221 | B2 | | 3/2008 | Wikel et al. | |
| 2003/0104842 | A1 | | 6/2003 | Choi et al. | |
| 2004/0180631 | A1 | | 9/2004 | Lin et al. | |
| 2007/0258613 | A1 | | 11/2007 | Wright | |
| 2008/0096493 | A1 | | 4/2008 | Kerwood | |

* cited by examiner

*Primary Examiner* — Robert J Sandy
*Assistant Examiner* — David Upchurch
(74) *Attorney, Agent, or Firm* — James Ray & Assoc

(57) ABSTRACT

An apparatus for one of substantially minimizing damage to and loss of earbuds when not in use. Such apparatus comprises an elongated member formed of a predetermined material and a loop member engageable with a first end of the elongated member for securing such earbud when such loop member is tightened over such earbud thereby securing it thereto. A crimp bead member is disposed intermediate such first end of such elongated member and such loop member, such crimp bead member capable of sliding so as to tighten the loop member and close the loop member over such earbud. A clip member is engageable with a second end of the elongated member for engagement with a preselected object for securing the elongated member having such loop member attached thereto with such earbud disposed therein to such preselected object. There is, further, a clasp member for securing the second end of the elongated member to the clip member.

11 Claims, 2 Drawing Sheets

WIRELESS EARBUD SAFETY LOOP

CROSS REFERENCE TO RELATED APPLICATIONS

This application is closely related to and claims benefit from U.S. Provisional Application Ser. No. 61/077,203 filed Jul. 1, 2008.

FIELD OF THE INVENTION

The present invention relates, in general, to an apparatus for securing an earbud, and, more particularly, the present invention relates to an apparatus to which an earbud can be attached so as to prevent loss and/or damage to such earbud.

BACKGROUND OF THE INVENTION

There are a numerous types of earbuds that are presently on the market. One problem with all of the earbuds is that are constantly being lost or damaged when not in use, since these items are somewhat fragile and do not lend themselves to easy storage. Some users of earbuds can lose them simply by removing them from the ears. Many people, at home or at work wear earbuds when performing routine tasks. Earbuds that are worn around the neck when not in use can be damaged easily. The frustrating occurrence of losing and subsequently replacing earbuds can also prove to be quite expensive.

Thus, it would be advantageous if there were a simple and relatively inexpensive means that would enable a user to have a convenient way to keep earbuds connected and close by.

SUMMARY OF THE INVENTION

In a first aspect the present invention provides an apparatus for one of substantially minimizing damage to and loss of earbuds when not in use. Such apparatus comprises an elongated member formed of a predetermined material and a loop member engageable with a first end of said elongated member for securing such earbud thereto when such loop member is tightened over such earbud thereby securing it thereto. A crimp bead member is disposed intermediate such first end of such elongated member and such loop member, such crimp bead member capable of sliding so as to tighten the loop member and close the loop member over such earbud. A clip member is engageable with a second end of the elongated member for engagement with a preselected object for securing the elongated member having such loop member attached thereto with such earbud disposed therein to such preselected object. There is, further, a means for securing the second end of the elongated member to the clip member.

OBJECTS OF THE INVENTION

It is, therefore, one of the primary objects of the present invention to provide an apparatus which will offer a convenient way to keep earbuds handy and safe when not in use.

Another object of the present invention is to provide an apparatus that includes a safety loop for securing the earbud.

Still another object of the present invention is to provide an apparatus which is relatively inexpensive.

Yet another object of the present invention is to provide an apparatus which is made of a nylon coated stainless steel wire.

In addition to the various objects and advantages of the invention which have been described in some specific detail above it should be noted that various other objects and advantages of the present invention will become more readily apparent to those persons who are skilled in the relevant art from the following more detailed description, particularly when such description is taken in conjunction with the appended claims.

Figure 1:
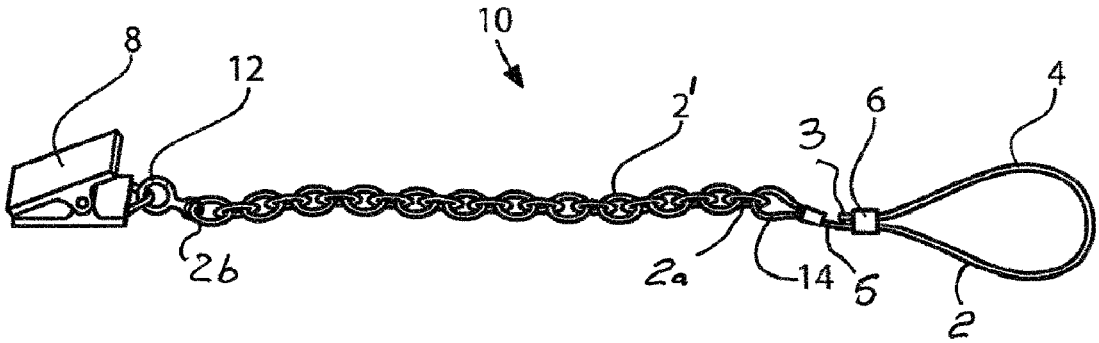
FIG. 1 is a perspective view of the apparatus according to an embodiment of the invention wherein the elongated member is in the form of a chain.
Figure 2:
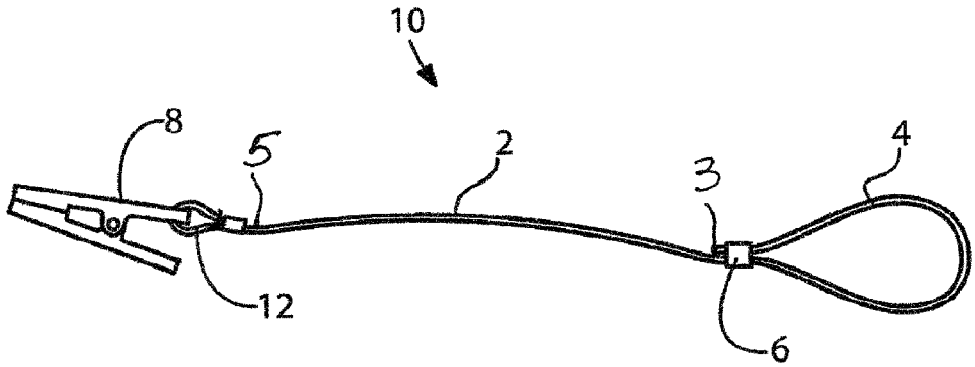
FIG. 2 is a perspective view of the apparatus according to an embodiment of the invention wherein the elongated member and the loop member are formed as a single entity.
Figure 3:
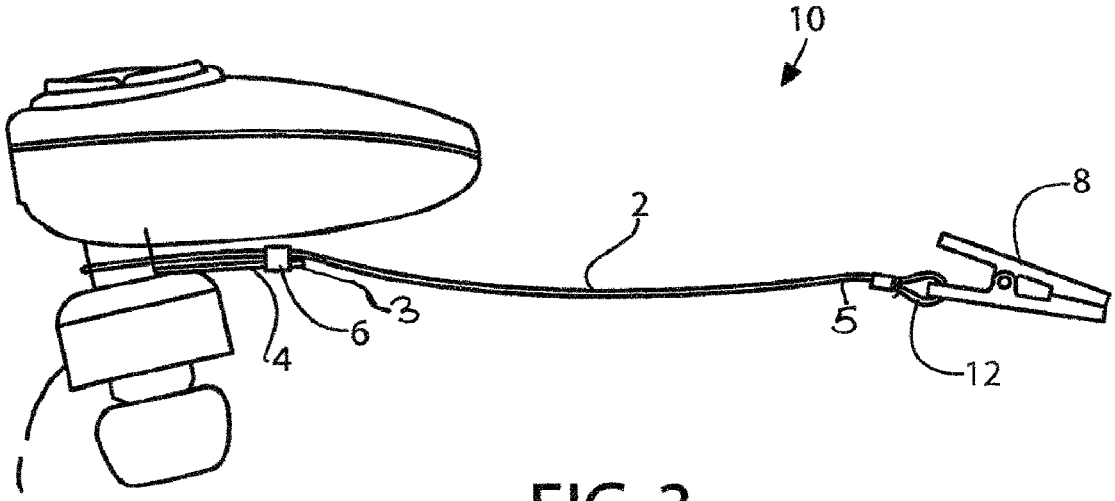
FIG. 3 is a side perspective view of the apparatus wherein such apparatus has an earbud disposed in the loop.
Figure 4:
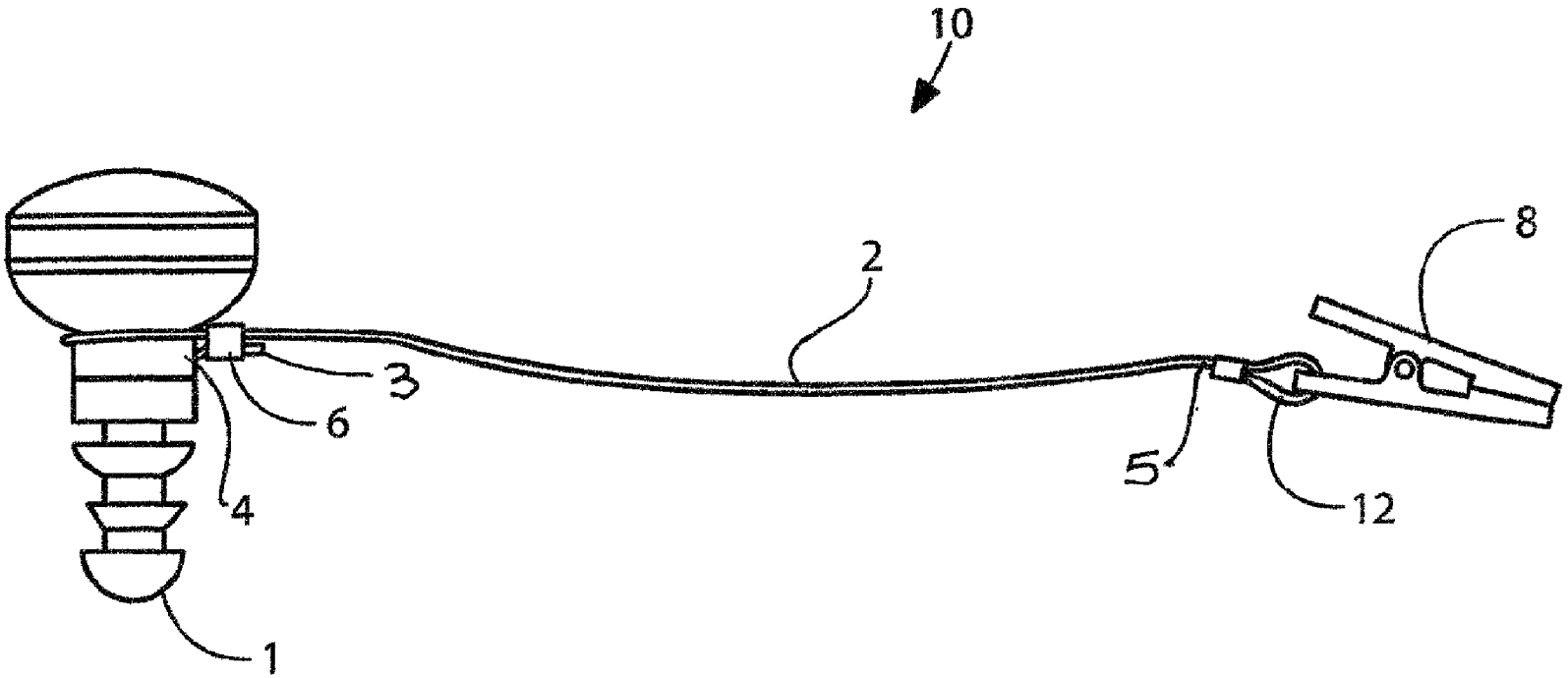
FIG. 4 is a side perspective view of the apparatus wherein such apparatus has a different type of earbud disposed in the loop.

The present invention relates, in general, to an apparatus for securing an earbud.

BRIEF DESCRIPTION OF THE PRESENTLY PREFERRED AND VARIOUS ALTERNATIVE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

In a first aspect the present invention provides an apparatus, generally designated 10, for one of substantially minimizing damage to and loss of earbuds 1 when not in use. Such apparatus 10 comprises an elongated member 2 formed of a predetermined material and a loop member 4 engageable with a first end 3 of the elongated member 2 for securing such earbud 1 thereto when such loop member 4 is tightened over such earbud 1 thereby securing it thereto. A crimp bead 6 member is disposed intermediate such first end of such elongated member 2 and such loop member 4, such crimp bead member 6 capable of sliding so as to tighten the loop member 4 and close the loop member 4 over such earbud 1. A clip member 8 is engageable with a second end of the elongated member 2 for engagement with a preselected object for securing the elongated member 2 having such loop member 4 attached thereto with such earbud 1 disposed therein to such preselected object. It is presently preferred that such clip member 8 is an alligator clip 8.

There is, further, a means 12 for securing the second end of the elongated member 2 to the clip member 8. It is presently preferred that such means 12 is a clasp 12.

It is presently preferred that such elongated member 2 is formed of stainless steel. In one embodiment of the invention such elongated member 2 is in a form of a chain 2. In an alternate embodiment of the invention such elongated member 2 and such loop member 4 are formed as a single entity. In this embodiment the elongated member 2 and the loop member 4 are formed of a stainless steel wire. It is presently preferred that such wire is coated with nylon.

Such apparatus 10 further includes a second means for securing such loop member 4 to the elongated member 2 when they are not formed as a single entity, consisting of the elongated member 2 and another elongated member 2' having a first end 2*a* and an opposite second end 2*b*. It is preferred that such second means is a clasp 14.

Such preselected object is selected from a group including a purse, jacket, shirt, belt and a briefcase. Such object can be other than those named; however, these are listed as some objects that can be used that are handy and easily accessible when one wants to retrieve the earbud 1 for use. Thus, the earbud 1 is safely stored and is easily recovered.

While a presently preferred embodiment and alternate embodiments of the present invention have been described in detail above, it should be understood that various other adaptations and/or modifications of the invention can be made by those persons who are particularly skilled in the art without departing from either the spirit of the invention or the scope of the appended claims.

I claim:

1. An apparatus for one of substantially minimizing damage to and loss of earbuds when not in use, said apparatus consisting of:

(a) one elongated member;

(b) a loop member defined at a first end of said one elongated member for securing the earbud thereto when said loop member is tightened over the earbud thereby securing it thereto;

(c) a crimp bead member disposed intermediate said first end of said one elongated member and said loop member, wherein said first end extends past an end of said crimp bead member, said crimp bead member adapted for sliding along said one elongated member so as to tighten said loop member and close said loop member over the earbud in a manner substantially minimizing damage to and loss of the earbud when not in use;

(d) another elongated member having a first end thereof disposed in close proximity to a second end of said one elongated member;

(e) means for securing said second end of said one elongated member to said first end of said another elongated member;

(f) a clip member engageable with a second end of said another elongated member; and (g) means for securing said second end of said another elongated member to said clip member.

2. The apparatus, according to claim 1, wherein said one elongated member is formed of stainless steel.

3. The apparatus, according to claim 1 wherein said another elongated member and said loop member are formed as a single entity.

4. The apparatus, according to claim 1, wherein said elongated member and said loop member are formed of wire.

5. The apparatus, according to claim 4, wherein said wire is coated with nylon.

6. The apparatus, according to claim 1, wherein said one elongated member is in a form of a chain.

7. The apparatus, according to claim 6, wherein said apparatus further includes a second means for securing said loop member to said elongated member.

8. The apparatus, according to claim 1, wherein said clip member is an alligator clip.

9. The apparatus, according to claim 1, wherein said means for securing said second end of said elongated member to said clip member includes a clasp member.

10. The Apparatus of claim 1, wherein said means for securing said second end of said one elongated member to said first end of said another elongated member is a clasp member.

11. The Apparatus of claim 1, wherein said means for securing said second end of said another elongated member to said clip member is a clasp member.

* * * * *